US011835918B2

(12) United States Patent
Iwanaga

(10) Patent No.: US 11,835,918 B2
(45) Date of Patent: Dec. 5, 2023

(54) IMAGE FORMING APPARATUS

(71) Applicant: CANON KABUSHIKI KAISHA, Tokyo (JP)

(72) Inventor: Ayumu Iwanaga, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/861,516

(22) Filed: Jul. 11, 2022

(65) Prior Publication Data

US 2023/0028961 A1 Jan. 26, 2023

(30) Foreign Application Priority Data

Jul. 13, 2021 (JP) ..... 2021-115479
Jun. 17, 2022 (JP) ..... 2022-097827

(51) Int. Cl.
*G03G 21/18* (2006.01)
*G03G 15/08* (2006.01)
*G03G 15/00* (2006.01)

(52) U.S. Cl.
CPC ..... *G03G 21/1857* (2013.01); *G03G 15/0865* (2013.01); *G03G 15/757* (2013.01); *G03G 2221/1657* (2013.01)

(58) Field of Classification Search
CPC ..... G03G 21/1857; G03G 15/0865; G03G 15/757; G03G 2221/1657; F16H 1/20
See application file for complete search history.

(56) References Cited

U.S. PATENT DOCUMENTS

| | | | | |
|---|---|---|---|---|
| 11,073,787 | B2 * | 7/2021 | Maeshima | G03G 21/1803 |
| 2012/0070206 | A1 * | 3/2012 | Tsukioka | G03G 15/2032 399/329 |
| 2016/0098000 | A1 * | 4/2016 | Furuichi | F16H 7/18 399/329 |
| 2017/0308007 | A1 * | 10/2017 | Imaizumi | G03G 15/1615 |
| 2019/0265638 | A1 * | 8/2019 | Shimizu | G03G 15/0865 |
| 2021/0039902 | A1 * | 2/2021 | Takahashi | G03G 15/6502 |

FOREIGN PATENT DOCUMENTS

| | | | |
|---|---|---|---|
| JP | H04219550 | A | 8/1992 |
| JP | 2002014501 | A | 1/2002 |
| JP | 6736616 | B2 | 8/2020 |

* cited by examiner

*Primary Examiner* — Francis C Gray
(74) *Attorney, Agent, or Firm* — ROSSI, KIMMS & McDOWELL LLP

(57) ABSTRACT

A direction in which a first drive transmission gear urges a first drive gear using a first urging portion when a drive force is not input to a first drive input portion is defined as a first direction. A direction in which a second drive transmission gear urges a second drive gear using a second urging portion when a drive force is not input to a second drive input portion is defined as a second direction. The second direction has a force component in a direction opposite to the first direction with respect to a straight line connecting a rotation center of the first drive gear and a rotation center of the second drive gear.

12 Claims, 9 Drawing Sheets

IMAGE FORMING APPARATUS

BACKGROUND OF THE INVENTION

Field of the Invention

The present invention relates to an image forming apparatus such as a copying machine, a printer, a facsimile, and a multifunction peripheral having a plurality of functions thereof.

Description of the Related Art

In an image forming apparatus, an electrostatic latent image formed on an image bearing member is developed with a developer to form a toner image by a developing unit. Such a developing unit is driven by transmission of a drive force from a motor provided in an image forming apparatus body. As such a driving configuration, a configuration in which a drive force from a motor is transmitted to a developing unit via a drive transmission gear and a drive gear is conventionally known (for example, Japanese Patent Application Laid-Open No. 2002-14501).

In the case of the configuration described in Japanese Patent Application Laid-Open No. 2002-14501, with respect to a drive gear connected to a driving configuration (developer bearing member) of a developing unit, a drive transmission gear is provided to be movable between a transmission position where the drive force can be transmitted to the drive gear and a retracting position where the drive transmission gear is retracted from the drive gear.

Here, the developing unit includes a developer bearing member for supplying a developer to an image bearing member to develop an electrostatic latent image, and is pressed toward the image bearing member in order to appropriately maintain a gap between the developer bearing member and the image bearing member. On the other hand, as described above, in the configuration in which the drive transmission gear is movable between the transmission position and the retracting position, the drive transmission gear is urged toward the drive gear so that the drive transmission gear meshes with the drive gear.

For this reason, when the drive transmission gear is moved to the transmission position and the drive transmission gear is brought into contact with the drive gear, a force caused by an urging force for urging the drive transmission gear is also generated in the developing unit. Depending on the direction of the force, the force with which the developing unit is pressed toward the image bearing member becomes unstable, and it becomes difficult to appropriately maintain the gap between the developer bearing member and the image bearing member. If the gap is not appropriate, an image defect may occur.

SUMMARY OF THE INVENTION

The present invention appropriately maintains a gap between a developer bearing member and an image bearing member.

According to a first aspect of the present invention, an image forming apparatus includes an image bearing member, a developing unit including a developer container configured to accommodate a developer, a developer bearing member configured to bear and convey the developer in the developer container to develop an electrostatic latent image formed on the image bearing member, a conveying member configured to convey the developer in the developer container, a first drive gear configured to drive the developer bearing member, and a second drive gear configured to drive the conveying member, a mounting portion configured to mount the developing unit, a first drive input portion to which a drive force is input, the first drive input portion including a first drive transmission gear configured to mesh with the first drive gear in a state where the developing unit is mounted to the mounting portion and input the drive force to the first drive gear, and a first urging portion configured to urge the first drive transmission gear toward the first drive gear, a second drive input portion to which a drive force is input, the second drive input portion including a second drive transmission gear configured to mesh with the second drive gear in a state where the developing unit is mounted to the mounting portion and inputs the drive force to the second drive gear, and a second urging portion configured to urge the second drive transmission gear toward the second drive gear, and, a contact-separation mechanism configured to bring the first drive transmission gear and the second drive transmission gear into contact with or to be separated from the first drive gear and the second drive gear, respectively, in a case where the developing unit is mounted to and dismounted from the mounting portion. In a state in which the first drive transmission gear is brought into contact with the first drive gear and the second drive transmission gear is brought into contact with the second drive gear by the contact-separation mechanism, in a case where a direction in which the first drive transmission gear urges the first drive gear using the first urging portion when the drive force is not input to the first drive input portion is defined as a first direction, and a direction in which the second drive transmission gear urges the second drive gear using the second urging portion when the drive force is not input to the second drive input portion is defined as a second direction, the second direction has a force component in a direction opposite to the first direction with respect to a straight line connecting a rotation center of the first drive gear and a rotation center of the second drive gear.

According to a second aspect of the present invention, an image forming apparatus includes an image bearing member, a developing unit including a developer container configured to accommodate a developer, a first developer bearing member configured to bear and convey the developer in the developer container to develop an electrostatic latent image formed on the image bearing member, a second developer bearing member arranged in parallel with the first developer bearing member via a predetermined gap, and configured to bear and convey the developer to develop the electrostatic latent image formed on the image bearing member, a conveying member configured to convey the developer in the developer container, a first drive gear configured to drive the first developer bearing member and the second developer bearing member, and a second drive gear configured to drive the conveying member, a mounting portion configured to mount the developing unit, a first drive input portion to which a drive force is input, the first drive input portion including a first drive transmission gear configured to mesh with the first drive gear in a state where the developing unit is mounted to the mounting portion and input the drive force to the first drive gear, and a first urging portion configured to urge the first drive transmission gear toward the first drive gear, a second drive input portion to which a drive force is input, the second drive input portion including a second drive transmission gear configured to mesh with the second drive gear in a state where the developing unit is mounted to the mounting portion and input the drive force to the second drive gear, and a second urging portion configured to urge the second drive transmission gear toward the second drive gear, and, a contact-separation mechanism configured to bring the first drive transmission gear and the second drive transmission gear into contact with or to be separated from the first drive gear and the second drive gear, respectively, in a case where the developing unit is mounted to and dismounted from the mounting portion. In a state in which the first drive transmission gear is brought into contact with the first drive gear and the second drive transmission gear is brought into contact with the second drive gear by the contact-separation mechanism, in a case where a direction in which the first drive transmission gear urges the first drive gear using the first urging portion when the drive force is not input to the first drive input portion is defined as a first direction, and a direction in which the second drive transmission gear urges the second drive gear using the second urging portion when the drive force is not input to the second drive input portion is defined as a second direction, the second direction has a force component in a direction opposite to the first direction with respect to a straight line connecting a rotation center of the first drive gear and a rotation center of the second drive gear.

Further features of the present invention will become apparent from the following description of exemplary embodiments with reference to the attached drawings.

DESCRIPTION OF THE EMBODIMENTS

First Embodiment

A first embodiment will be described with reference to FIGS. 1 to 8. First, a schematic configuration of an image forming apparatus according to the present embodiment will be described.

Image Forming Apparatus

Figure 1:
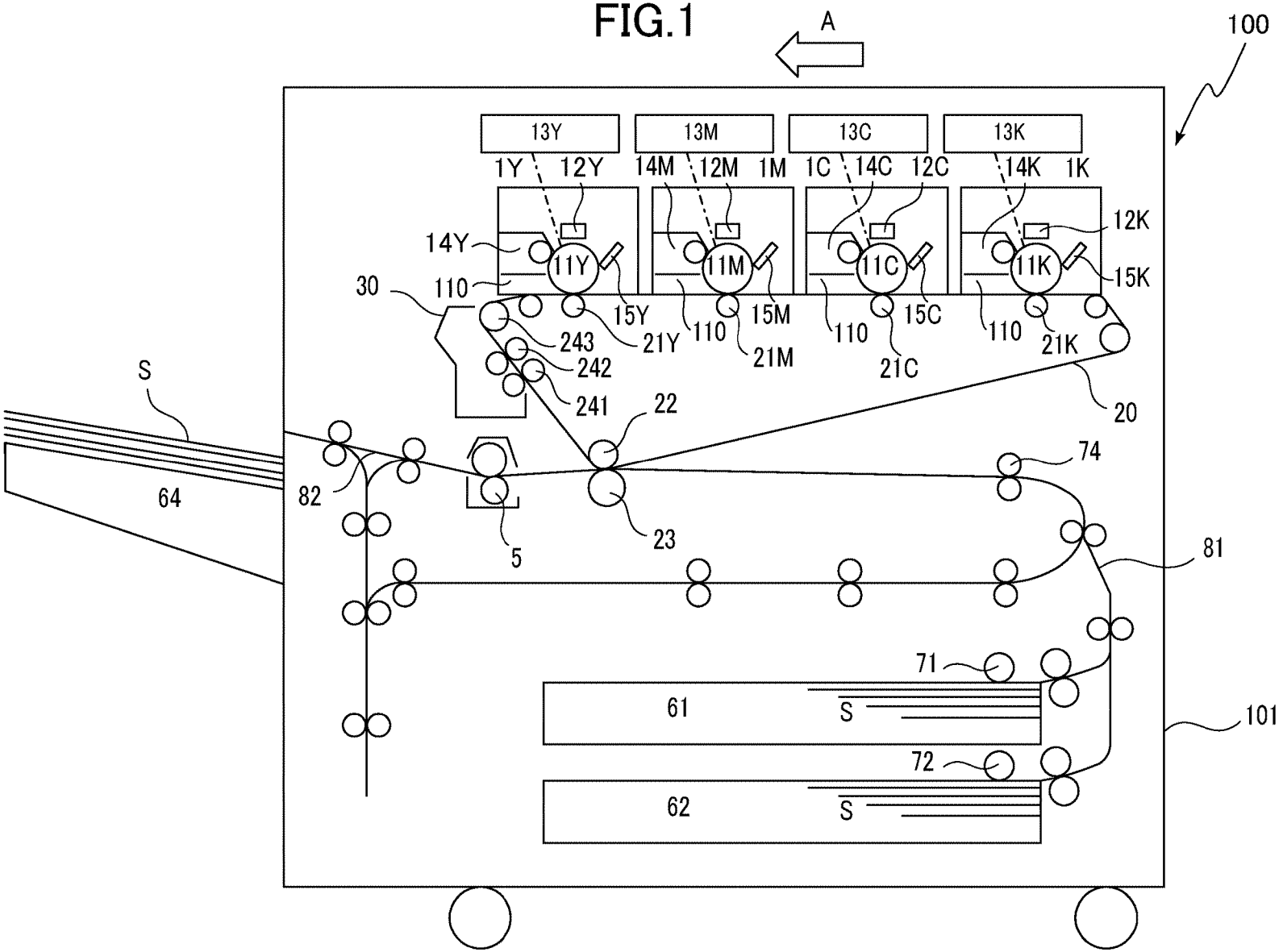
FIG. 1 is a schematic cross-sectional view of a configuration of an image forming apparatus according to a first embodiment.

FIG. 1 is a schematic configuration cross-sectional view illustrating an image forming apparatus 100 according to the present embodiment. The image forming apparatus 100 is a tandem-type intermediate-transfer-type image forming apparatus in which a plurality of (in the present embodiment, four) image forming units 1Y, 1M, 1C, and 1K are arranged in series in a horizontal portion of an intermediate transfer belt 20. The image forming units 1Y, 1M, 1C, and 1K are disposed in the image forming apparatus body 101.

The image forming apparatus 100 forms a full-color image on a recording material S by an electrophotographic system according to an image signal transmitted from an external device such as a host computer. Note that the order of these image forming units is an example, and these image forming units are not limited to this position, and the number of these image forming units is not limited.

The image forming units 1Y, 1M, 1C, and 1K form toner images of respective colors of yellow, magenta, cyan, and black on photosensitive drums 11Y, 11M, 11C, and 11K as image bearing members, respectively, and primarily transfer the toner images to the same image position on the intermediate transfer belt 20. The photosensitive drums 11Y, 11M, 11C, and 11K are cylindrical photosensitive members.

A charging device 12Y, an exposing unit 13Y, a developing unit 14Y, and a cleaning device 15Y are disposed around the photosensitive drum 11Y that forms a yellow toner image. The charging device 12Y uniformly charges the surface of the photosensitive drum 11Y. The exposing unit 13Y irradiates the photosensitive drum 11Y with image light to form an electrostatic latent image on the surface. The developing unit 14Y transfers toner to the electrostatic latent image formed on the photosensitive drum 11Y to develop the electrostatic latent image as a toner image. The cleaning device 15Y removes toner remaining on the photosensitive drum 11Y after the primary transfer of the toner image. The configuration for forming magenta, cyan, and black toner images is understood by replacing the suffix Y with M, C, and K in the above description.

The intermediate transfer belt 20 is an endless belt that is stretched by a plurality of stretching rollers and rotates when a drive force is input to one of the rollers. The stretching rollers include primary transfer rollers 21Y, 21M, 21C, and 21K and a secondary transfer inner roller 22, and these rollers are pivotally supported by an intermediate transfer belt frame (not illustrated). The primary transfer rollers 21Y, 21M, 21C, and 21K are disposed at positions in contact with the photosensitive drums 11Y, 11M, 11C, and 11K via the intermediate transfer belt 20 to form a primary transfer portion. When a primary transfer voltage is applied to the primary transfer rollers 21Y, 21M, 21C, and 21K, the toner images formed on the photosensitive drums 11Y, 11M, 11C, and 11K are primarily transferred onto the intermediate transfer belt 20. A secondary transfer member 23 is disposed at a position in contact with the secondary transfer inner roller 22 via the intermediate transfer belt 20 to form a secondary transfer portion. When a secondary transfer voltage is applied to either the secondary transfer inner roller 22 or the secondary transfer member 23, the toner image on the intermediate transfer belt 20 is secondarily transferred to the recording material S. The transfer residual toner remaining on the intermediate transfer belt 20 after the secondary transfer and an unnecessary toner image are removed by a cleaning device 30.

On the other hand, the recording material S stored in feeding cassettes 61 and 62 is conveyed to a feeding conveyance path 81 as feed rollers 71 and 72 rotate. The recording material S is, for example, a sheet material such as paper or a plastic sheet. A registration roller 74 feeds the recording material S to the secondary transfer portion in timing with the toner image on the intermediate transfer belt 20. The recording material S to which the toner image has been transferred is conveyed to a fixing unit 5 and heated and crimped, whereby the toner image is fixed to the surface of the recording material S, and the full-color image is fixed. Thereafter, the recording material S is sent out to a sheet discharge tray 64 through a discharge conveyance path 82. Note that the positions and the number of the feeding cassettes and the sheet discharge trays are one example, and are not limited to these positions and the number.

Developing Unit

Figure 2:
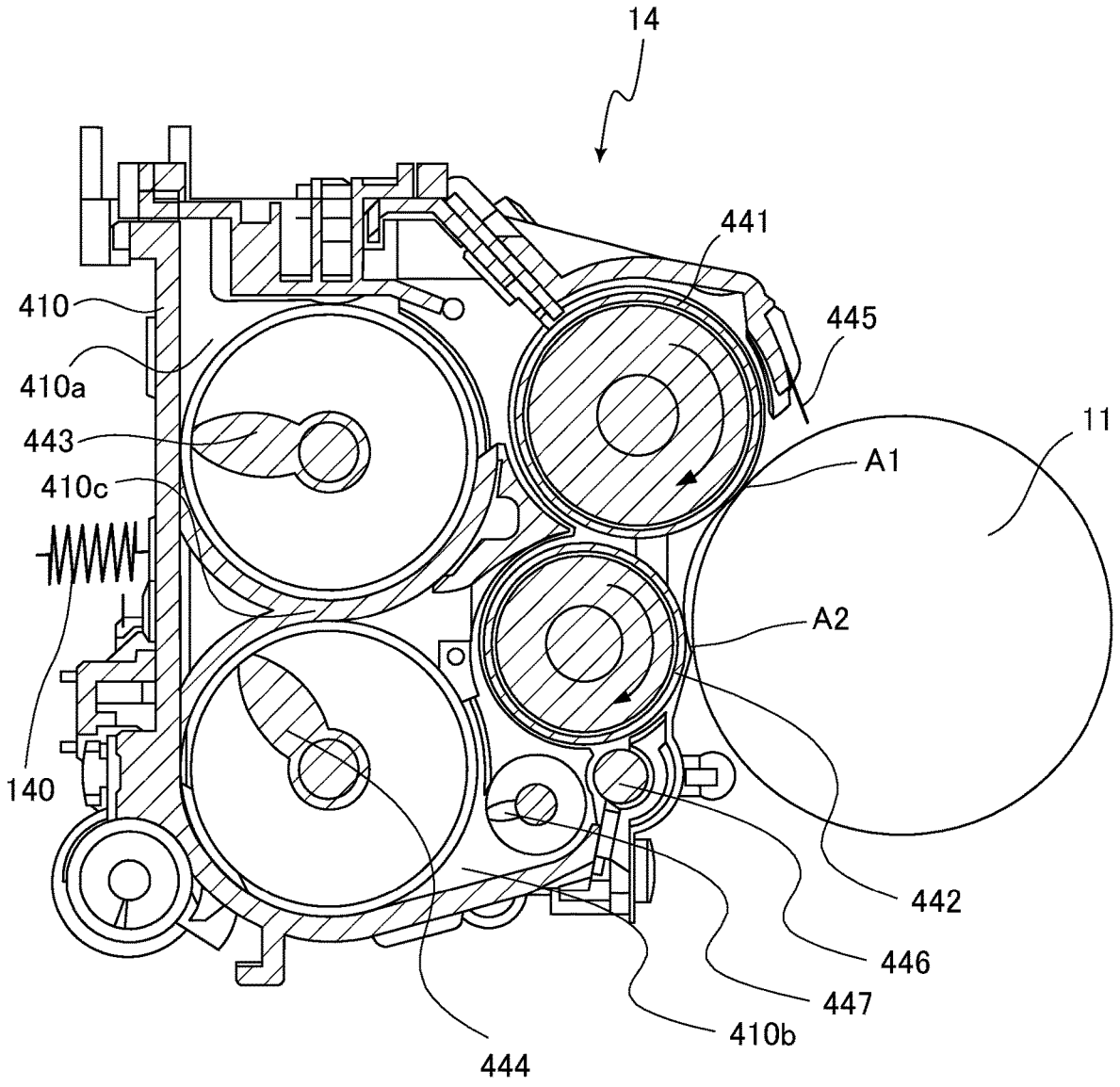
FIG. 2 is a schematic cross-sectional view of the configuration of a developing unit according to the first embodiment.
Figure 3:
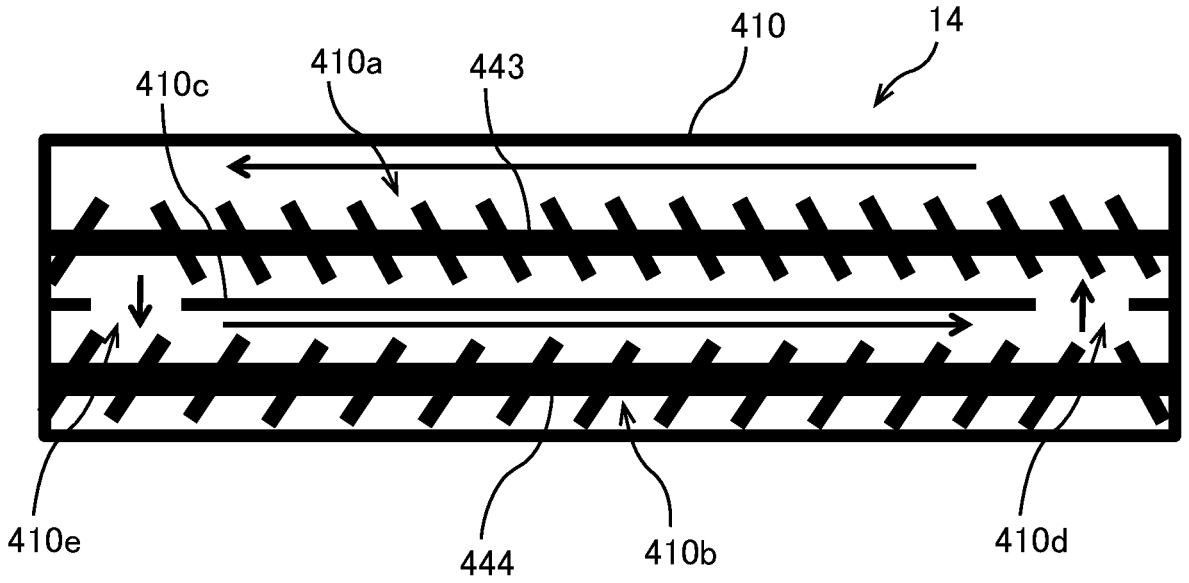
FIG. 3 is a schematic longitudinal cross-sectional view of a configuration of the developing unit according to the first embodiment.

Next, configurations of the developing units 14Y to 14K of the present embodiment will be described with reference to FIGS. 2 and 3. Note that the developing units 14Y to 14K have the same configuration except for different developing colors, and thus the subscripts Y to K will be omitted below. The same applies to the photosensitive drums 11Y to 11K. FIG. 2 is a cross-sectional view of the developing unit 14 taken in a direction orthogonal to the rotational axis direction of a first developing sleeve 441 and a second developing sleeve 442. FIG. 3 is a cross-sectional view taken along the rotational axis direction of the first developing sleeve 441 and the second developing sleeve 442 by a first conveying screw 443 and a second conveying screw 444.

The developing unit 14 is detachable from the image forming apparatus body 101 (FIG. 1). Specifically, the developing unit 14 can be inserted into and removed from a mounting portion 110 of the image forming apparatus body 101 in a direction perpendicular to the paper surface of FIG. 1. In addition, the developing unit 14 can be separated from the photosensitive drum 11 in the direction of arrow A illustrated in FIG. 1. That is, when the developing unit 14 is removed from the image forming apparatus body 101, the developing unit 14 is separated from the photosensitive drum 11 in the direction of arrow A. On the other hand, when the developing unit 14 is inserted into the image forming apparatus body 101 and mounted to the mounting portion 110, the developing unit 14 is moved in the direction opposite to the direction of arrow A, and the first developing sleeve 441 and the second developing sleeve 442 are positioned at positions facing the photosensitive drum 11 with a predetermined gap interposed therebetween. At this time, the developing unit 14 is pressed in a pressing direction (a direction from the rotation center of the first developing sleeve 441 toward the rotation center of the photosensitive drum 11, and a direction from the rotation center of the second developing sleeve 442 toward the rotation center of the photosensitive drum 11) toward the photosensitive drum 11 by a pressing member 140 (FIG. 2) such as a spring, and a part of the developing unit 14 and a part on the photosensitive drum 11 side abut on each other. Thus, the above-described gap (a gap between first developing sleeve 441 and photosensitive drum 11, and a gap between second developing sleeve 442 and photosensitive drum 11) is maintained at an appropriate size.

In the embodiment in which flanges are provided at both ends in the longitudinal direction of the photosensitive drum 11, for example, the abutting rollers provided at both ends in the longitudinal direction of the first developing sleeve 441 and the second developing sleeve 442 abut on the flanges provided at both ends in the longitudinal direction of the photosensitive drum 11. As a result, the above-described gap is maintained at an appropriate size. On the other hand, in the embodiment in which flanges are not provided at both ends in the longitudinal direction of the photosensitive drum 11, for example, the abutting rollers provided at both ends in the longitudinal direction of the first developing sleeve 441 and the second developing sleeve 442 abut on the element tube of the photosensitive drum 11. As a result, the above-described gap (a gap between first developing sleeve 441 and photosensitive drum 11, and a gap between second developing sleeve 442 and photosensitive drum 11) is maintained at an appropriate size.

As illustrated in FIG. 2, the developing unit 14 includes a developer container 410 that accommodates a developer. The developer of the present embodiment is a so-called two-component developer containing a nonmagnetic toner and a carrier having magnetism. The first developing sleeve 441 serving as a first developer bearing member and the second developing sleeve 442 serving as a developer bearing member and a second developer bearing member are rotatably supported by the developer container 410. The first developing sleeve 441 and the second developing sleeve 442 are disposed in parallel with the rotational axis direction of the photosensitive drum 11, and develop the electrostatic latent image on the surface of the photosensitive drum 11 with a developer. The second developing sleeve 442 is located below the first developing sleeve 441 and is disposed in parallel with the first developing sleeve 441 with a predetermined gap interposed therebetween.

The developer container 410 is provided with a regulating blade 445 that regulates the layer thickness of the developer borne on the first developing sleeve 441. The first developing sleeve 441 bears a developer supplied from a developing chamber 410*a* described later on a surface thereof and conveys the developer. The second developing sleeve 442 is provided below the first developing sleeve 441, and bears the developer delivered from the first developing sleeve 441 on the surface and conveys the developer. Each of the first developing sleeve 441 and the second developing sleeve 442 is formed in a cylindrical shape, and a magnet is disposed inside thereof in a non-rotating manner. The first developing sleeve 441 and the second developing sleeve 442 are rotationally driven in the directions of arrows illustrated in FIG. 2, and bear and convey the developer by the magnetic attraction force of the magnet.

The developer container 410 is partitioned by a partition wall 410*c* extending in the horizontal direction into an upper developing chamber (a developer conveying passage) 410*a* serving as a first chamber and a stirring chamber (a developer conveying passage) 410*b* serving as a second chamber located below the developing chamber 410*a*. The developing chamber 410*a* is a functional chamber that supplies a developer to the first developing sleeve 441. The stirring chamber 410*b* is a functional chamber that receives and stirs the developer collected from the second developing sleeve 442, the excess developer not supplied to the first developing sleeve 441 in the developing chamber 410*a*, and the replenishment developer replenished from the outside of the developing unit 4.

In each of the developing chamber 410*a* and the stirring chamber 410*b*, a first conveying screw 443 serving as a conveying member and a first conveying member, and a second conveying screw 444 serving as a second conveying member are provided. Each of the first conveying screw 443 and the second conveying screw 444 is a screw member in which a spiral blade is provided on a rotation shaft disposed substantially parallel to the rotational axis direction (longitudinal direction) of the first developing sleeve 441 and the second developing sleeve 442.

As illustrated in FIG. 3, a first communicating portion 410*d* and a second communicating portion 410*e*, which are delivery portions (developer conveyance paths) for conveying the developer between the developing chamber 410*a* and the stirring chamber 410*b*, are provided on both end sides in the longitudinal direction of the partition wall 410*c*. The first communicating portion 410*d* is formed with an opening that allows the developer to move from the stirring chamber 410*b* to the developing chamber 410*a*. The second communicating portion 410*e* is formed with an opening that allows the developer to move from the developing chamber 410*a* to the stirring chamber 410*b*.

The first conveying screw 443 is disposed to face the first developing sleeve 441, and supplies the developer to the first developing sleeve 441 while rotating so as to stir and convey the developer in a first direction from the first communicating portion 410*d* toward the second communicating portion 410*e*. The second conveying screw 444 rotates so as to stir and convey the developer in a second direction from the second communicating portion 410*e* toward the first communicating portion 410*d*. The second conveying screw 444 is disposed below the first conveying screw 443 in the direction of gravity, and the second direction is opposite to the first direction. By such rotation operation of the first conveying screw 443 and the second conveying screw 444, the developer in the developer container is circulated while being stirred and conveyed.

The developing unit 14 is provided with a collecting member 446 disposed below the second developing sleeve 442 to face the second developing sleeve 442 and disposed substantially parallel to the rotational axis direction of the second developing sleeve 442. The collecting member 446 is provided with a predetermined space from the second developing sleeve 442, and collects the developer that has not been developed in the second developing sleeve 442. That is, the collecting member 446 collects the developer remaining on the second developing sleeve 442 (on a developer bearing member, on a second developer bearing member) after developing the electrostatic latent image formed on the photosensitive drum 11. The collecting member 446 is a cylindrical member and rotates together with the second developing sleeve 442.

In addition, the developing unit 14 is provided with a third conveying screw 447 serving as a third conveying member and a stirring member. The third conveying screw 447 is adjacent to the collecting member 446, collect the developer that has not been developed in the second developing sleeve 442, and convey the developer collected by the collecting member 446 to the second conveying screw 444 while stirring the developer. That is, the third conveying screw 447 is disposed below the second developing sleeve 442, collects the developer from the second developing sleeve 442, and stirs and conveys the developer. The third conveying screw 447 is a screw member in which a spiral blade is provided on a rotation shaft arranged substantially parallel to the rotational axis direction of the first developing sleeve 441 and the second developing sleeve 442.

In such a developing unit 14, the first developing sleeve 441 rotates in the clockwise direction in FIG. 2 during development, the developer is supplied from the developing chamber 410*a*, and bears the two-component developer whose layer thickness is regulated by the brush cutting of the magnetic brush by the regulating blade 445. Then, this is conveyed to a developing region A1 facing the photosensitive drum 11, and a developer is supplied to the electrostatic latent image formed on the photosensitive drum 11 to develop the latent image. The photosensitive drum 11 rotates counterclockwise in FIG. 2.

On the other hand, the second developing sleeve 442 rotates in the clockwise direction in FIG. 2 during development, and the developer is delivered from the surface of the first developing sleeve 441 that has passed through the developing region A1. The developer delivered to the second developing sleeve 442 is conveyed to a developing region A2 downstream of the developing region A1 in the rotation direction of the photosensitive drum 11, and the developer is supplied again to the electrostatic latent image formed on the photosensitive drum 11 to develop the latent image. Thereafter, the developer contributing to development is collected by the collecting member 446 from the second developing sleeve 442, conveyed by the third conveying screw 447, and delivered to the second conveying screw 444.

Driving Configuration of Developing Device

Figure 4:
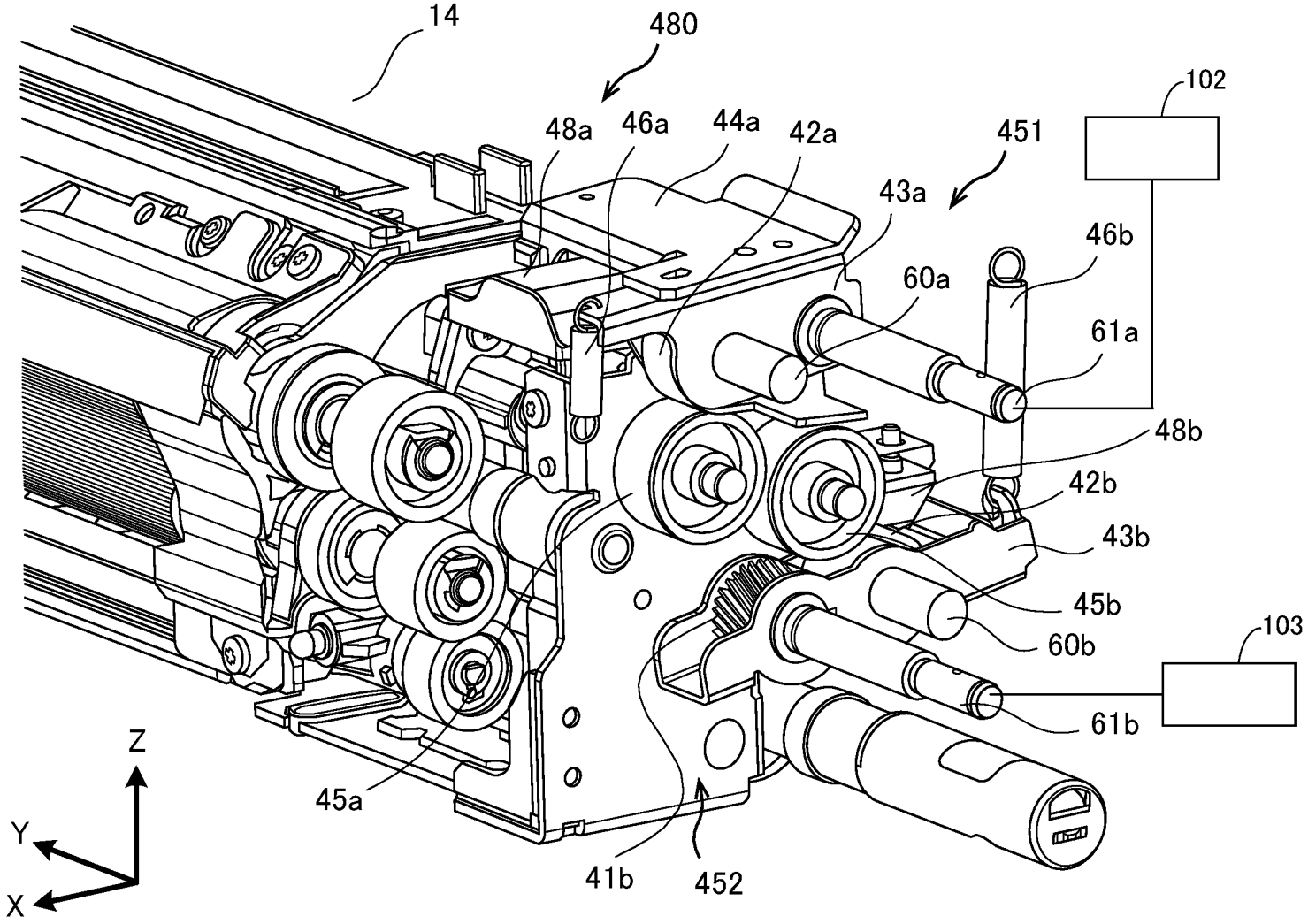
FIG. 4 is a perspective view illustrating a driving configuration of the developing unit according to the first embodiment.
Figure 5:
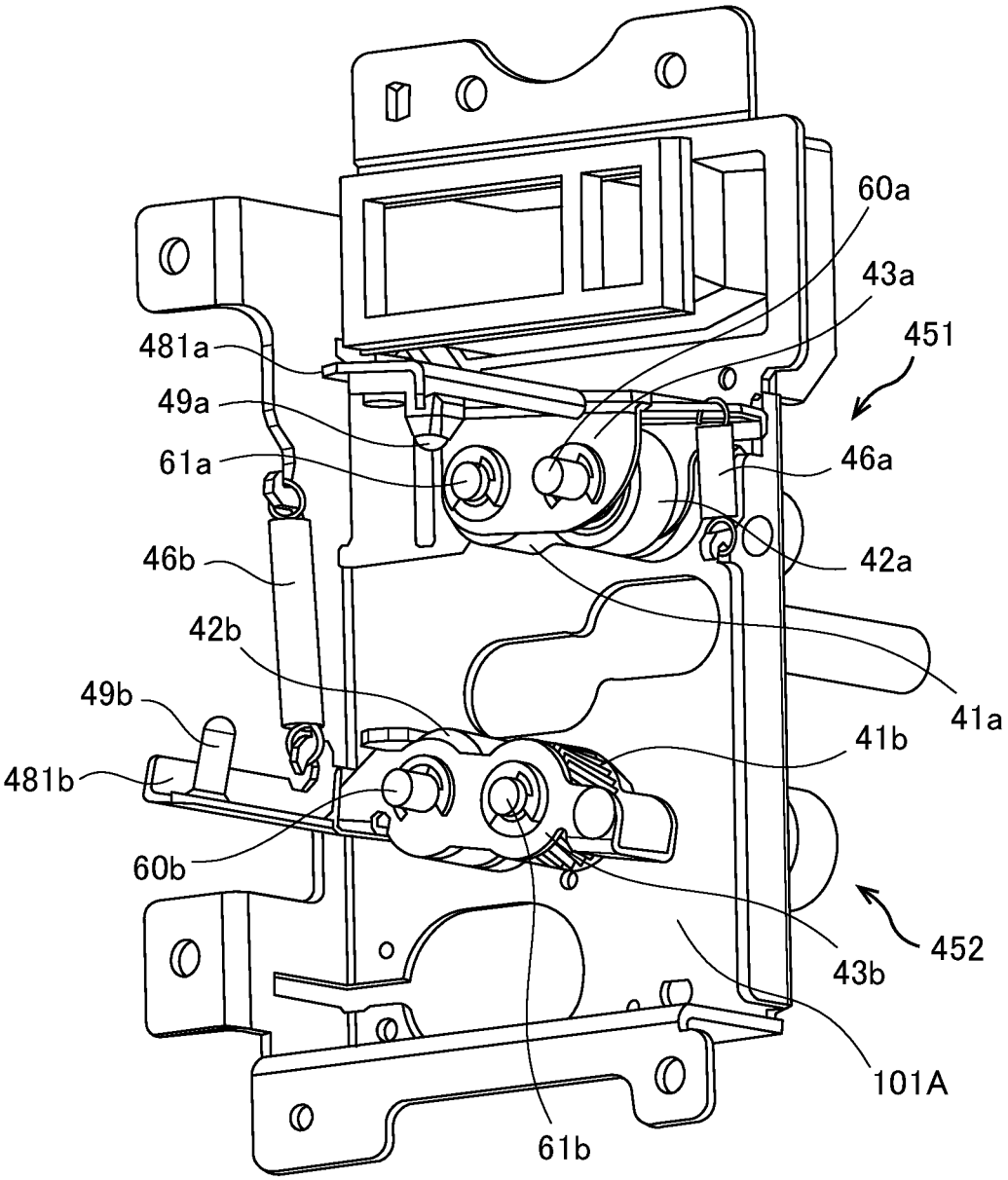
FIG. 5 is a perspective view illustrating a driving configuration on a main body side of the image forming apparatus according to the first embodiment.

Next, a driving configuration of the developing unit 14 will be described with reference to FIGS. 4 to 8. First, the entire driving configuration of the developing unit 14 that transmits a drive force from the image forming apparatus body 101 to the developing unit 14 and drives the developing unit 14 will be described with reference to FIGS. 4 and 5. FIG. 4 is a perspective view of the developing unit 14 as viewed from the back side. FIG. 5 is a perspective view of the driving configuration on the image forming apparatus body 101 side as viewed from the developing unit 14 side.

The developing unit 14 receives a drive force from a drive source (motor) in the image forming apparatus body, and the first developing sleeve 441, the second developing sleeve 442, the first conveying screw 443, the second conveying screw 444, and the third conveying screw 447 rotate. At this time, in the developing unit 14, a drive force is transmitted from two different drive sources to the first drive gear 45*a* and the second drive gear 45*b*, respectively. Specifically, as illustrated in FIG. 4, a drive force is input from a first motor 102 serving as a first drive source provided in the image forming apparatus body 101 to a first drive gear (sleeve drive gear) 45*a* via a first drive input portion 451. In addition, a drive force is input from a second motor 103 serving as a second drive source provided in the image forming apparatus body 101 to a second drive gear (screw drive gear) 45*b* via a second drive input portion 452.

The drive input to the first drive gear 45*a* and the second drive gear 45*b* may be input from one motor via a clutch. Then, by switching the disconnection and connection of the power by the clutch, driving may be performed independently or simultaneously. That is, as long as the first drive gear 45*a* and the second drive gear 45*b* can be driven independently of each other, a drive force may be input from separate motors, or a drive force may be input from one motor via a clutch.

The first drive gear 45*a* transmits the drive force input from a first drive input portion 451 to the first developing sleeve 441, the second developing sleeve 442, and the third conveying screw 447. That is, the first drive gear 45*a* constitutes a gear train together with a gear connected to the first developing sleeve 441, a gear connected to the second developing sleeve 442, and a gear connected to the third conveying screw 447. Then, when the first drive gear 45*a* rotates, the drive force is transmitted to each gear, and the first developing sleeve 441, the second developing sleeve 442, and the third conveying screw 447 rotate.

The second drive gear 45*b* transmits the drive force input from the second drive input portion 452 to the first conveying screw 443 and the second conveying screw 444. That is, the second drive gear 45*b* constitutes a gear train together with a gear connected to the first conveying screw 443 and a gear connected to the second conveying screw 444. Then, when the second drive gear 45*b* rotates, the drive force is transmitted to each gear, and the first conveying screw 443 and the second conveying screw 444 rotate. That is, the developing unit 14 of the present embodiment has a configuration in which the drive forces input from the two drive input portions are transmitted to the respective units via different drive transmission paths (for example, gear trains).

Configuration of Drive Input Portion

Next, configurations of the first drive input portion 451 and the second drive input portion 452 will be described with reference to FIGS. 4 and 5. The first drive input portion 451 and the second drive input portion 452 are provided in the image forming apparatus body 101. Specifically, it is provided on the back side in the insertion direction of the developing unit 14 to be described later, and is connected to the developing unit 14 so as to be able to transmit a drive force when the developing unit 14 is inserted to a predetermined position of the mounting portion 110 (FIG. 1).

The first drive input portion 451 includes a first drive transmission gear 42*a*, a first swing center gear 41*a*, a first housing 43*a*, and a first spring 46*a* serving as a first urging portion. The first drive transmission gear 42*a* meshes with the first drive gear 45*a* to input a drive force to the first drive gear 45*a*. The first swing center gear 41*a* is disposed so as to mesh with the first drive transmission gear 42*a*. The first housing 43*a* is provided to be swingable about the first swing center gear 41*a* together with the first drive transmission gear 42*a*. The first spring 46*a* urges the first housing 43*a* such that the first drive transmission gear 42*a* moves toward the first drive gear 45*a*.

The second drive input portion 452 includes a second drive transmission gear 42*b*, a second swing center gear 41*b*, a second housing 43*b*, and a second spring 46*b* serving as a second urging portion. The second drive transmission gear 42*b* meshes with the second drive gear 45*b* to input a drive force to the second drive gear 45*b*. The second swing center gear 41*b* is disposed so as to mesh with the second drive transmission gear 42*b*. The second housing 43*b* is provided so as to be swingable about the second swing center gear 41*b* together with the second drive transmission gear 42*b*. The second spring 46*b* urges the second housing 43*b* such that the second drive transmission gear 42*b* moves toward the second drive gear 45*b*.

Specifically, the first and second swing center gears 41*a* and 41*b* are rotatably supported by swing center shafts 61*a* and 61*b*, respectively, communicating with holes provided in the first and second housings 43*a* and 43*b*. The first and second drive transmission gears 42*a* and 42*b* are rotatably supported by drive transmission shafts 60*a* and 60*b*, respectively, communicating with holes provided in the first and second housings 43*a* and 43*b*, respectively.

The swing center shafts 61*a* and 61*b* communicating with the first and second swing center gears 41*a* and 41*b* are rotated by drive forces transmitted from the first motor 102 and the second motor 103, respectively. The swing center shafts 61*a* and 61*b* rotate together with the first and second swing center gears 41*a* and 41*b*, respectively. The first and second swing center gears 41*a* and 41*b* and the first and second drive transmission gears 42*a* and 42*b* are always arranged in a meshed state, and the first and second drive transmission gears 42*a* and 42*b* rotate as the first and second swing center gears 41*a* and 41*b* rotate. That is, the drive forces from the first motor 102 and the second motor 103 are transmitted to the first and second drive transmission gears 42*a* and 42*b* via the swing center shafts 61*a* and 61*b* and the first and second swing center gears 41*a* and 41*b*, respectively.

Insertion and Removal Configuration of Developing Unit

Figure 6A:
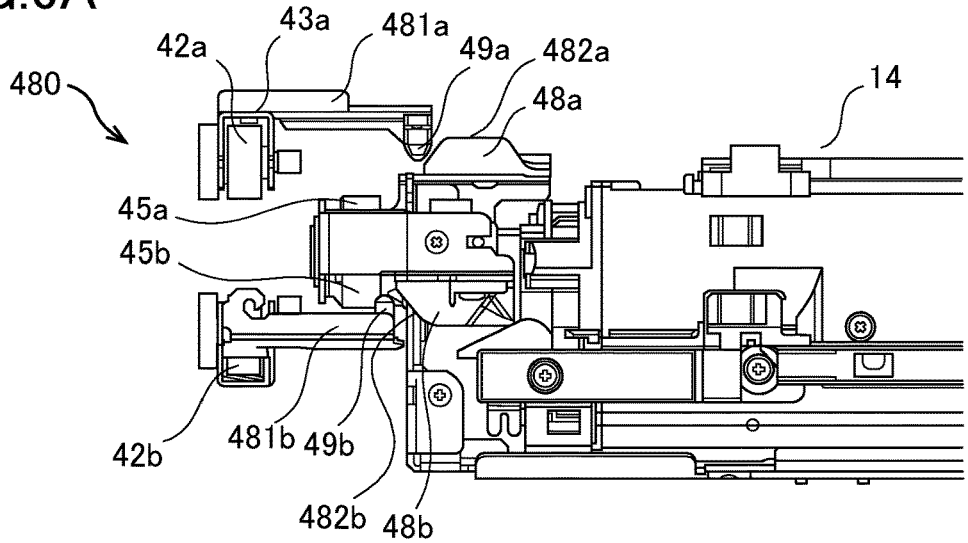
FIG. 6A is a longitudinal sectional view of the developing unit according to the first embodiment when the developing unit is mounted to the main body of the image forming apparatus, and illustrates a state at the start of insertion.
Figure 6B:
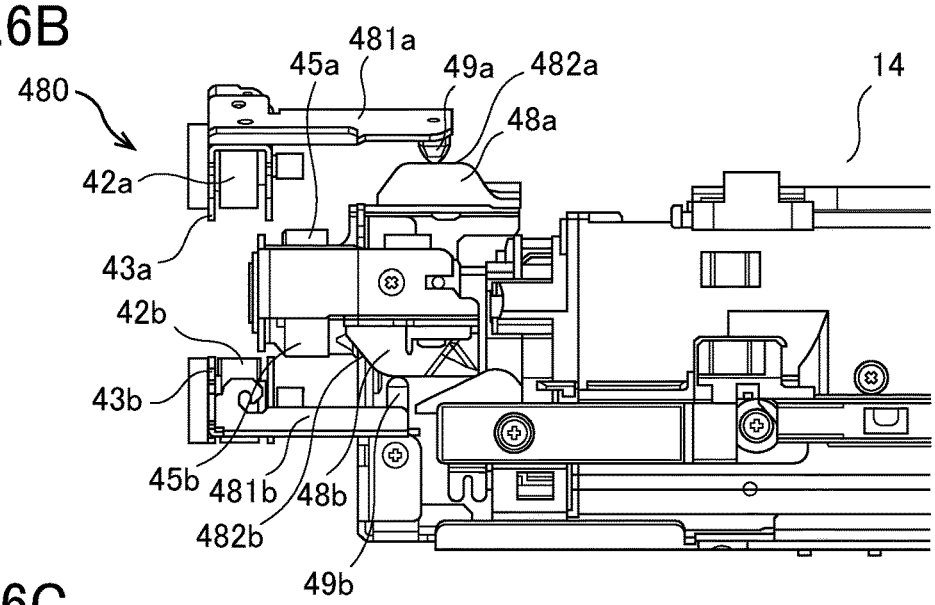
FIG. 6B is a longitudinal sectional view of the developing unit according to the first embodiment when the developing unit is mounted to the main body of the image forming apparatus, and illustrates a state in the middle of insertion.
Figure 6C:
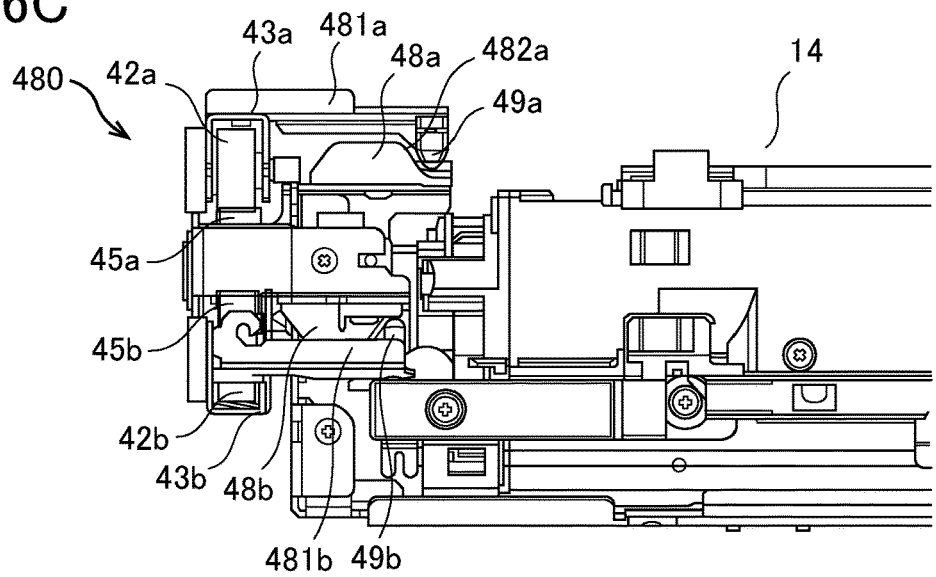
FIG. 6C is a longitudinal sectional view of the developing unit according to the first embodiment when the developing unit is mounted to the main body of the image forming apparatus, and illustrates a state at the completion of insertion.

Next, an insertion and removal configuration of the developing unit 14 with respect to the image forming apparatus body 101 will be described using FIGS. 6A to 6C with reference to FIGS. 4 and 5. FIGS. 6A to 6C are views when the developing unit 14 is inserted into the image forming apparatus body 101, and are views of the image forming apparatus body 101 as viewed from the left side of FIG. 1. As described above, in the first and second drive input portions 451 and 452, the first and second drive transmission gears 42*a* and 42*b* are swingable about the swing center shafts 61*a* and 61*b* of the first and second swing center gears 41*a* and 41*b* together with the first and second housings 43*a* and 43*b*. In the present embodiment, with this configuration, the first and second drive transmission gears 42*a* and 42*b* can be brought into contact with or separated from the first and second drive gears 45*a* and 45*b* when the developing unit 14 is inserted into or removed from the image forming apparatus body 101.

In the present embodiment, there is provided a contact-separation mechanism 480 that enables the first and second drive transmission gears 42*a* and 42*b* to be brought into contact with or separated from the first and second drive gears 45*a* and 45*b* at the time of mounting and dismounting the developing unit 14 to and from the image forming apparatus body 101. The contact-separation mechanism 480 includes guide arms 481*a* and 481*b* provided in the first and second housings 43*a* and 43*b*, pins 49*a* and 49*b* serving as protrusions provided at the distal ends of the guide arms 481*a* and 481*b*, and guide cams 48*a* and 48*b*. Then, the contact-separation mechanism 480 can move the first and second drive transmission gears 42*a* and 42*b* between a contact position (transmission position) where the first and second drive transmission gears 42*a* and 42*b* are brought into contact with the first and second drive gears 45*a* and 45*b* and a retracting position where the first and second drive transmission gears 42*a* and 42*b* are retracted from the first and second drive gears 45*a* and 45*b* in accordance with the insertion and removal operation (mounting and dismounting operation) of the developing unit 14 by the engagement between the pins 49*a* and 49*b* and the guide cams 48*a* and 48*b*.

As illustrated in FIG. 4, the first drive input portion 451 and the second drive input portion 452 are disposed so as to sandwich the first drive gear 45*a* and the second drive gear 45*b* provided in the developing unit 14. As illustrated in FIGS. 5 and 6A to 6C, the guide arms 481*a* and 481*b* are provided so as to protrude toward the upstream side in the insertion direction of the developing unit 14, and the pins

49*a* and 49*b* are provided at the distal ends thereof so as to protrude toward the first drive gear 45*a* and the second drive gear 45*b*.

The guide cams 48*a* and 48*b* have cam surfaces 482*a* and 482*b* provided at end portions on the back side in the insertion direction (downstream side, distal end side) of the developing unit 14 and changing in angle along the insertion direction. As will be described later, the cam surfaces 482*a* and 482*b* are engaged with the pins 49*a* and 49*b* when the developing unit 14 is inserted and removed. Then, as the pins 49*a* and 49*b* move along the cam surfaces 482*a* and 482*b* in accordance with the insertion and removal operation, the guide arms 481*a* and 481*b* and the first and second housings 43*a* and 43*b* move.

The first spring 46*a* is disposed so as to extend between the end of the first housing 43*a* on the side opposite to the swing center shaft 61*a* and the frame 101A of the image forming apparatus body 101, and urges the first housing 43*a* and the first drive transmission gear 42*a* toward the first drive gear 45*a*. Similarly, the second spring 46*b* is disposed so as to extend between the end of the second housing 43*b* on the side opposite to the swing center shaft 61*b* and the frame 101A of the image forming apparatus body 101, and urges the second housing 43*b* and the second drive transmission gear 42*b* toward the second drive gear 45*b*.

When the developing unit 14 is inserted into the image forming apparatus body 101, as illustrated in FIG. 6A, the cam surfaces 482*a* and 482*b* of the guide cams 48*a* and 48*b* attached to the developing unit 14 come into contact with the pins 49*a* and 49*b* on the image forming apparatus body 101 side. At the initial stage of contact, the pins 49*a* and 49*b* ascend along the inclined surfaces of the cam surfaces 482*a* and 482*b* of the guide cams 48*a* and 48*b*, and accordingly, the first and second drive transmission gears 42*a* and 42*b* supported by the first and second housings 43*a* and 43*b* move to the retracting positions.

As illustrated in FIG. 6B, as the developing unit 14 is further inserted, the pins 49*a* and 49*b* climb up the inclined surfaces of the cam surfaces 482*a* and 482*b* and reach the flat portion. Then, the movement of the first and second drive transmission gears 42*a* and 42*b* to the retracting positions is completed. Thereafter, immediately before completion of the insertion of the developing unit 14, that is, immediately before reaching the predetermined position of the mounting portion 110 (FIG. 1), the pins 49*a* and 49*b* start to descend along the inclined surfaces on the upstream side in the insertion direction of the cam surfaces 482*a* and 482*b* by the urging forces of the first and second springs 46*a* and 46*b* (see FIG. 5) attached to the first and second housings 43*a* and 43*b*. Accordingly, the first and second drive transmission gears 42*a* and 42*b* start to move to the abutting positions, that is, the positions meshing with the first and second drive gears 45*a* and 45*b*.

As described above, immediately before the completion of the insertion of the developing unit 14, the first and second drive transmission gears 42*a* and 42*b* start to mesh with the first and second drive gears 45*a* and 45*b*, and as illustrated in FIG. 6C, when the insertion of the developing unit 14 is completed (when the developing unit 14 reaches a predetermined position of the mounting portion 110), the pins 49*a* and 49*b* are separated from the cam surfaces 482*a* and 482*b* of the guide cams 48*a* and 48*b*, and the meshing of the gears is completed. With the above configuration, the first and second drive transmission gears 42*a* and 42*b* and the first and second drive gears 45*a* and 45*b* can be meshed with each other without causing interference. Then, the drive force can be transmitted from the first and second drive transmission gears 42*a* and 42*b* to the first and second drive gears 45*a* and 45*b*.

Relationship Between Pressing and Non-Pressing Positions of Developing Unit

Next, the relationship between the first and second drive input portions 451 and 452 and the first and second drive gears 45*a* and 45*b* at the pressing and the non-pressing positions with respect to the photosensitive drum 11 of the developing unit 14 will be described with reference to FIGS. 7A and 7B. As described above, in a state where the developing unit 14 is mounted to the mounting portion 110, the developing unit is located at the pressing position where the developing unit 14 is pressed toward the photosensitive drum 11. On the other hand, when the developing unit 14 is pulled out from the mounting portion 110, the developing unit 14 is located at the non-pressing position separated from the pressing position. That is, the developing unit 14 is movable between the pressing position and the non-pressing position. In the present embodiment, the switching of the pressing state of the developing unit 14 is performed by switching the positions between the transmission position and the retracting position by the contact between the guide cams 48*a* and 48*b* and the pins 49*a* and 49*b* when the developing unit 14 is inserted into or removed from the mounting portion 110.

Figure 7A:
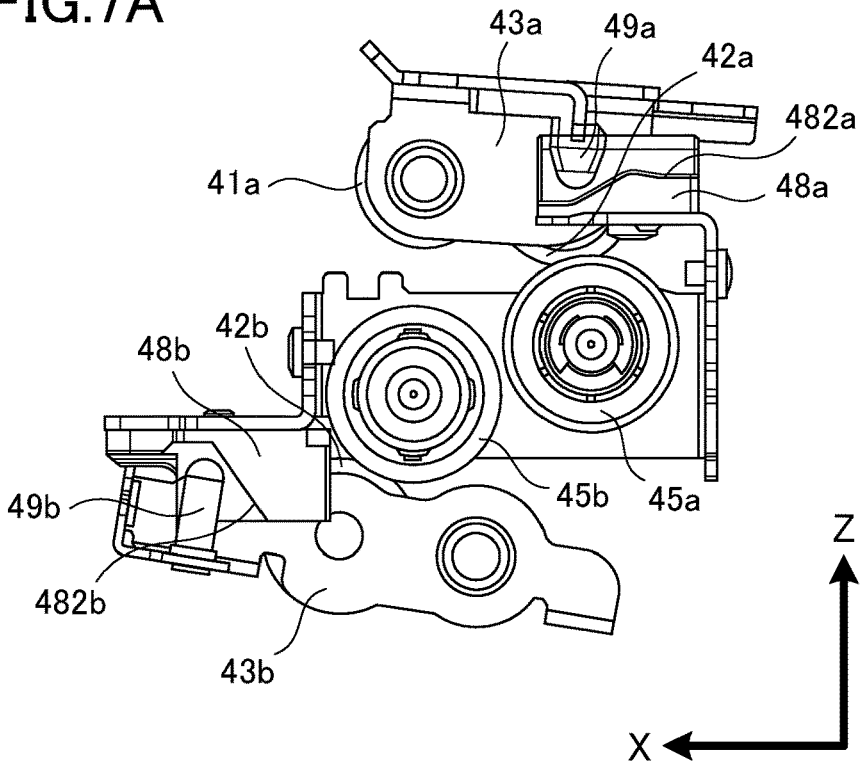
FIG. 7A is a view of a part of the driving configuration according to the first embodiment as viewed from the back side of the main body of the image forming apparatus, and illustrates a state in which a drive transmission gear and a drive gear mesh with each other.
Figure 7B:
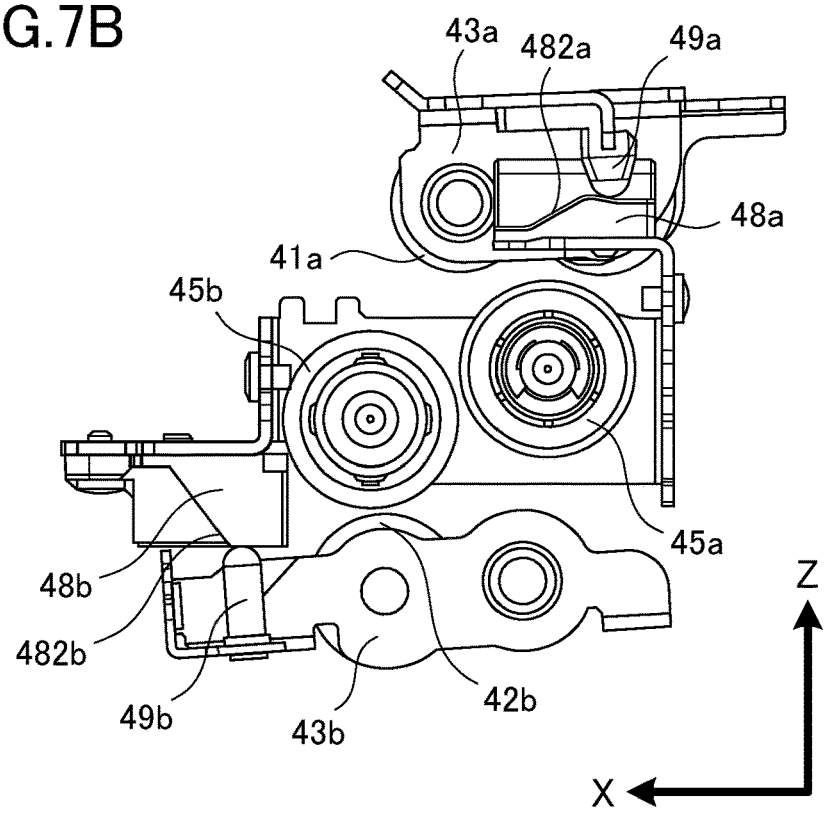
FIG. 7B is a view of a part of the driving configuration according to the first embodiment as viewed from the back side of the main body of the image forming apparatus, and illustrates a state in which the drive transmission gear and the drive gear are separated from each other.

FIGS. 7A and 7B illustrate meshing states of the first and second drive transmission gears 42*a* and 42*b* and the first and second drive gears 45*a* and 45*b* when viewed from the back surface side of the image forming apparatus body 101. FIG. 7A illustrates a positional relationship between the first and second drive transmission gears 42*a* and 42*b* and the first and second drive gears 45*a* and 45*b* at the pressing position of the developing unit 14 and the positions of the pins 49*a* and 49*b* with respect to the guide cams 48*a* and 48*b* at that time. FIG. 7B illustrates the positional relationship between the first and second drive transmission gears 42*a* and 42*b* and the first and second drive gears 45*a* and 45*b* at the non-pressing position of the developing unit 14, and the positions of the pins 49*a* and 49*b* with respect to the guide cams 48*a* and 48*b* at that time.

As illustrated in FIG. 7A, at the pressing position, the pins 49*a* and 49*b* are separated from the inclined surfaces of the cam surfaces 482*a* and 482*b* of the guide cams 48*a* and 48*b*, which is the same position as when the insertion of the developing unit 14 illustrated in FIG. 6C is completed. At this time, the first and second drive transmission gears 42*a* and 42*b* are meshed with the first and second drive gears 45*a* and 45*b*, and the drive force can be appropriately transmitted to the developing unit 14.

On the other hand, as illustrated in FIG. 7B, at the non-pressing position, the developing unit 14 moves in the −x direction (the right direction in FIG. 7B) from the pressing position, and accordingly, the pins 49*a* and 49*b* ascend the inclined surfaces of the cam surfaces 482*a* and 482*b* of the guide cams 48*a* and 48*b*. When the pins 49*a* and 49*b* reach the flat portions of the cam surfaces 482*a* and 482*b*, the developing unit 14 reaches the retracting position, which is the same position as the position of FIG. 6B. At this time, the first and second drive transmission gears 42*a* and 42*b* and the first and second drive gears 45*a* and 45*b* are in a non-contact state, and it is possible to prevent the developing sleeve and the conveying screw from rotating due to the contact/separation operation of the developing unit 14 with respect to the photosensitive drum 11.

The insertion and removal of the developing unit 14 with respect to the image forming apparatus body 101 can be performed regardless of the respective positions in the x direction (left and right direction in FIGS. 7A and 7B) of the pressing position and the non-pressing position. With this configuration, regardless of the position of the developing unit 14, the developing unit 14 can be inserted and removed so that the first and second drive transmission gears 42*a* and 42*b* do not interfere with the first and second drive gears 45*a* and 45*b*.

Arrangement of Drive Input Portion

Next, the arrangement of the first and second drive input portions 451 and 452 will be described with reference to FIG. 8. First, in the present embodiment, a direction (direction of urging force by the first spring 46*a*) in which the first drive transmission gear 42*a* urges the first drive gear 45*a* using the first spring 46*a* when the developing unit 14 is located at the pressing position and the first motor 102 is not driven is referred to as a first direction. Moreover, a direction (direction of urging force by the second spring 46*b*) in which the second drive transmission gear 42*b* urges the second drive gear 45*b* using the second spring 46*b* when the developing unit 14 is located at the pressing position and the second motor 103 is not driven is referred to as a second direction. In this case, the first and second drive input portions 451 and 452 are disposed such that the second direction has a force component in a direction opposite to the first direction with respect to straight line S connecting the rotation center of first drive gear 45*a* and the rotation center of second drive gear 45*b*.

Specifically, first drive transmission gear 42*a* and second drive transmission gear 42*b* are disposed on opposite sides of straight line S connecting a rotation center of first drive gear 45*a* and a rotation center of second drive gear 45*b*. In addition, when the developing unit 14 is located at the pressing position and the first motor 102 is driven, the urging force by the first spring 46*a* is defined as Fsa, the drive transmission force from the first drive transmission gear 42*a* to the first drive gear 45*a* is defined as Fga, the drive transmission force from the first swing center gear 41*a* to the first drive transmission gear 42*a* is defined as Fha, and a component of the resultant force in the same direction as the urging direction by the first spring 46*a* is defined as Fa. Further, when the developing unit 14 is located at the pressing position and the second motor 103 is driven, the urging force by the second spring 46*b* is defined as Fsb, the drive transmission force from the second drive transmission gear 42*b* to the second drive gear 45*b* is defined as Fgb, the drive transmission force from the second swing center gear 41*b* to the second drive transmission gear 42*b* is defined as Fhb, and the component of the resultant force in the same direction as the urging direction by the second spring 46*b* is defined as Fb. In this case, the first drive input portion 451 and the second drive input portion 452 are arranged such that a direction of Fa and a direction of Fb are directions in which the Fa and the Fb cancel each other.

This will be described more specifically. The first and second drive transmission gears 42*a* and 42*b* move on the circumference centered on the first and second swing center gears 41*a* and 41*b*, respectively, with the distance between the centers of the first and second drive transmission gears 42*a* and 42*b* and the first and second swing center gears 41*a* and 41*b* as a radius, and mesh with the first and second drive gears 45*a* and 45*b*. Therefore, the direction of the force Fsa by the urging force of the first spring 46*a* is a direction perpendicular to a straight line (line segment Ta in FIG. 8) connecting the rotation center of the first drive transmission gear 42*a* and the rotation center of the first swing center gear 41*a*. The direction of the force Fsb by the urging force of the second spring 46*b* is perpendicular to a straight line (line segment Tb in FIG. 8) connecting the rotation center of the second drive transmission gear 42*b* and the rotation center of the second swing center gear 41*b*.

When the developing unit 14 is located at the pressing position and the first and second motors 102 and 103 are driven, the force exerted from the first and second drive input portions 451 and 452 to the first and second drive gears 45*a* and 45*b* is as follows. That is, when the developing unit 14 is located at the pressing position and the first and second motors 102 and 103 are driven, the force is the resultant force of the three components including the forces Fsa and Fsb by the urging forces of the first and second springs 46*a* and 46*b*, the drive transmission forces Fga and Fgb from the first and second drive transmission gears 42*a* and 42*b* to the first and second drive gears 45*a* and 45*b*, and the drive transmission forces Fha and Fhb from the first and second swing center gears 41*a* and 41*b* to the first and second drive transmission gears 42*a* and 42*b*, respectively.

Figure 8:
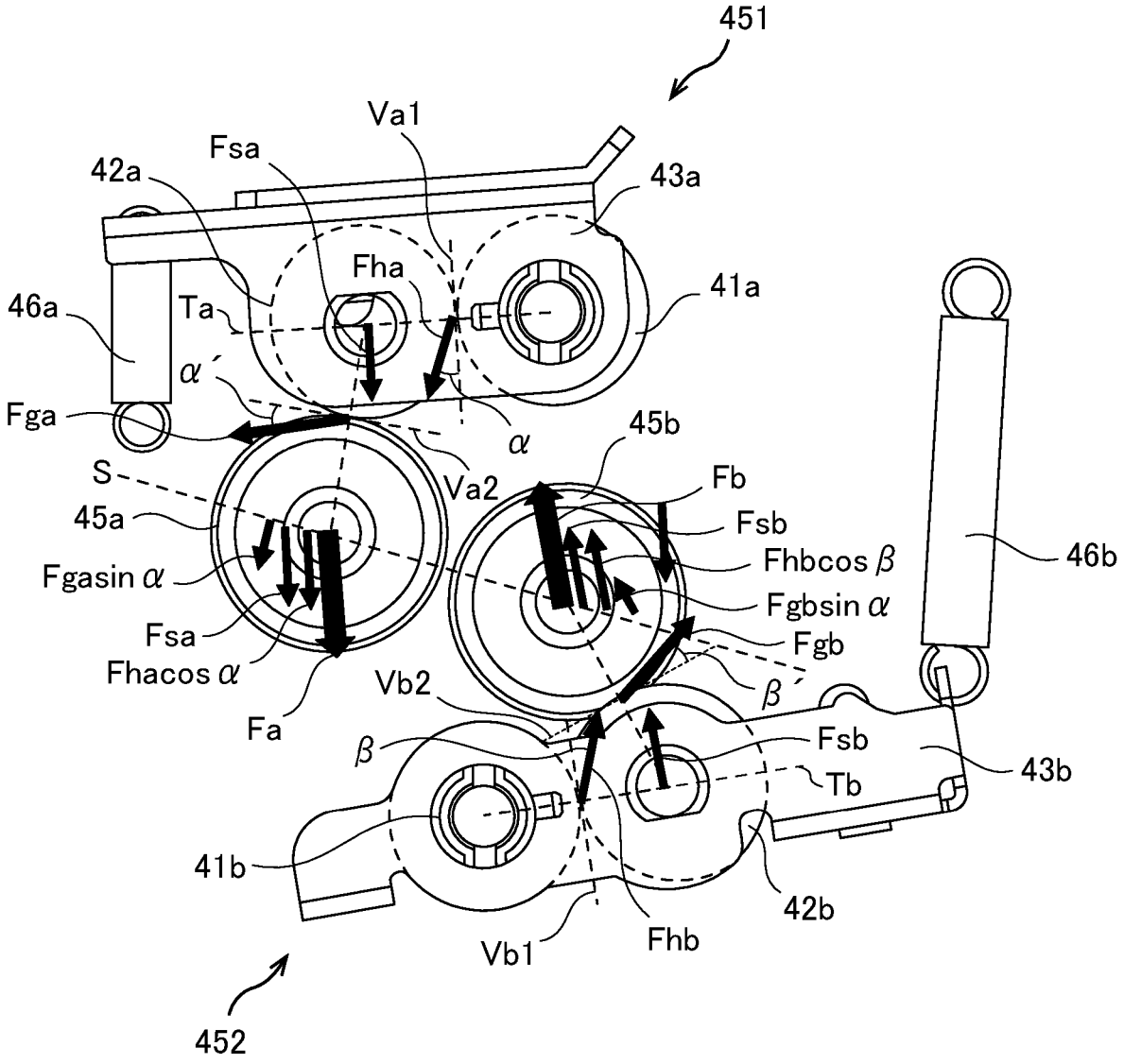
FIG. 8 is a diagram illustrating a relationship between forces generated in the driving configuration according to the first embodiment.

FIG. 8 illustrates the direction and position of each force when the developing unit 14 is located at the pressing position and the first and second motors 102 and 103 are driven. The drive transmission force Fha is inclined by a pressing angle $\alpha$ with respect to a perpendicular line (line segment Va1 in FIG. 8) of a straight line connecting the rotation center of the first swing center gear 41*a* and the rotation center of the first drive transmission gear 42*a*. The drive transmission force Fhb is inclined by a pressing angle $\beta$ with respect to a perpendicular line (line segment Vb1 in FIG. 8) of a straight line connecting the rotation center of the second swing center gear 41*b* and the rotation center of the second drive transmission gear 42*b*. The first and second drive input portions 451 and 452 rotate about the first and second swing center gears 41*a* and 41*b*, respectively. Therefore, forces actually exerted by Fha and Fhb on the rotation shafts of the first and second drive gears 45*a* and 45*b* are Fhacos$\alpha$ and Fhbcos$\beta$, respectively.

The drive transmission force Fga is inclined by a pressing angle $\alpha'$ with respect to a perpendicular line (line segment Va2 in FIG. 8) of a straight line connecting the rotation center of the first drive transmission gear 42*a* and the rotation center of the first drive gear 45*a*. The drive transmission force Fgb is inclined by a pressing angle $\beta'$ with respect to a perpendicular line (line segment Vb2 in FIG. 8) of a straight line connecting the rotation center of the second drive transmission gear 42*b* and the rotation center of the second drive gear 45*b*. Therefore, the forces actually exerted by Fga and Fgb on the rotation shafts of the first and second drive gears 45*a* and 45*b* are Fgasin$\alpha'$ and Fgbsin$\beta'$, respectively. In the present embodiment, since the first swing center gear 41*a*, the first drive transmission gear 42*a*, and the first drive gear 45*a* have the same tooth profile, the pressing angle $\alpha$ and the pressing angle $\alpha'$ have the same value. In the present embodiment, since the second swing center gear 41*b*, the second drive transmission gear 42*b*, and the second drive gear 45*b* have the same tooth profile, the pressing angle $\beta$ and the pressing angle $\beta'$ have the same value.

Based on this, the resultant force of the three forces on the first drive input portion 451 side when the developing unit 14 is located at the pressing position and the first and second motors 102 and 103 are driven is defined as Fa, and the resultant force of the three forces on the second drive input portion 452 side is defined as Fb. In the present embodiment, when the developing unit 14 is located at the pressing position and the first and second motors 102 and 103 are driven, the first drive input portion 451 and the second drive input portion 452 are arranged such that the resultant forces cancel each other. In particular, in the present embodiment, the first and second drive transmission gears 42*a* and 42*b* are disposed so as to sandwich a straight line (line segment S in FIG. 8) connecting the rotation center of the first drive gear 45*a* and the rotation center of the second drive gear 45*b*.

As a result, when the developing unit 14 is located at the pressing position and the first and second motors 102 and 103 are driven, the resultant force Fa acting on the first drive gear 45*a* from the first drive input portion 451 and the resultant force Fb acting on the second drive gear 45*b* from the second drive input portion 452 weaken each other. Thus, the influence on the pressing force of the developing unit 14 on the photosensitive drum 11 can be reduced. That is, as described above, when the developing unit 14 is located at the pressing position, the first and second drive transmission gears 42*a* and 42*b* are in contact with the first and second drive gears 45*a* and 45*b*, respectively, in a state of being urged by the first spring 46*a* and the second spring 46*b*, respectively. At this time, both when the developing unit 14 is at the pressing position and the first and second motors 102 and 103 are not driven, and when the developing unit 14 is at the pressing position and the first and second motors 102 and 103 are driven, there is a possibility that the pressing force of pressing the developing unit 14 toward the photosensitive drum 11 is affected depending on the direction of the force acting on the first and second drive gears 45*a* and 45*b*. If the pressing force of the developing unit 14 is affected, the gap of the first developing sleeve 441 with respect to the photosensitive drum 11 and the gap of the second developing sleeve 442 with respect to the photosensitive drum 11 may not be maintained at a predetermined gap.

For example, when the direction of the force acting on the first drive gear 45*a* and the direction of the force acting on the second drive gear 45*b* are in the same direction, the force acting on the first drive gear 45*a* and the force acting on the second drive gear 45*b* are in directions in which they strengthen each other. This means that the force of the component in the pressing direction in the force acting on the first drive gear 45*a* and the force of the component in the pressing direction in the force acting on the second drive gear 45*b* are added to the pressing force of the developing unit 14 by the pressing member 140. As a result, since the developing unit 14 is excessively pressed, it becomes difficult to appropriately maintain the gap between the first and second developing sleeves 441 and 442 and the photosensitive drum 11, and there is a possibility that an image defect occurs due to variation of the gap. On the other hand, in the present embodiment, first, the drive transmission path to the developing unit 14 is divided into two, and a drive force is input to the developing unit 14 from the two drive input portions including the first drive input portion 451 and the second drive input portion 452. In addition, the first and second drive input portions 451 and 452 are disposed such that the force acting on the first drive gear 45*a* from the first drive input portion 451 and the force acting on the second drive gear 45*b* from the second drive input portion 452 cancel each other.

Therefore, even when the developing unit 14 is located at the pressing position and the first and second drive transmission gears 42*a* and 42*b* mesh with the first and second drive gears 45*a* and 45*b*, forces in directions canceling each other act on the first and second drive gears 45*a* and 45*b*. As a result, since the force of the component in the pressing direction among the forces acting on the first drive gear 45*a* from the first drive input portion 451 and the force of the component in the pressing direction among the forces acting on the second drive gear 45*b* from the second drive input portion 452 cancel each other, the force added to the pressing force of the developing unit 14 by the pressing member 140 is reduced. That is, it is possible to reduce the influence of the force acting on the developing unit 14 due to the meshing between the first and second drive transmission gears 42*a* and 42*b* and the first and second drive gears 45*a* and 45*b* on the pressing force of the developing unit 14. Then, the gaps between the first and second developing sleeves 441 and 442 and the photosensitive drum 11 can be appropriately maintained, and the occurrence of image defects can be suppressed.

In the above description, the first and second springs 46*a* and 46*b* are used as a method of urging the first and second drive transmission gears 42*a* and 42*b*, but the present invention is not limited thereto. In addition, a method of guiding the positions of the first drive transmission gears 42*a* and 42*b* at the time of insertion and removal of the developing unit and at the time of pressing and non-pressing, that is, the guide arms 481*a* and 481*b*, the pins 49*a* and 49*b*, and the guide cams 48*a* and 48*b* extending from the first and second housings 43*a* and 43*b* are used as the contact-separation mechanism. However, the positions of the first and second drive transmission gears 42*a* and 42*b* may be guided by other methods.

Second Embodiment

Figure 9:
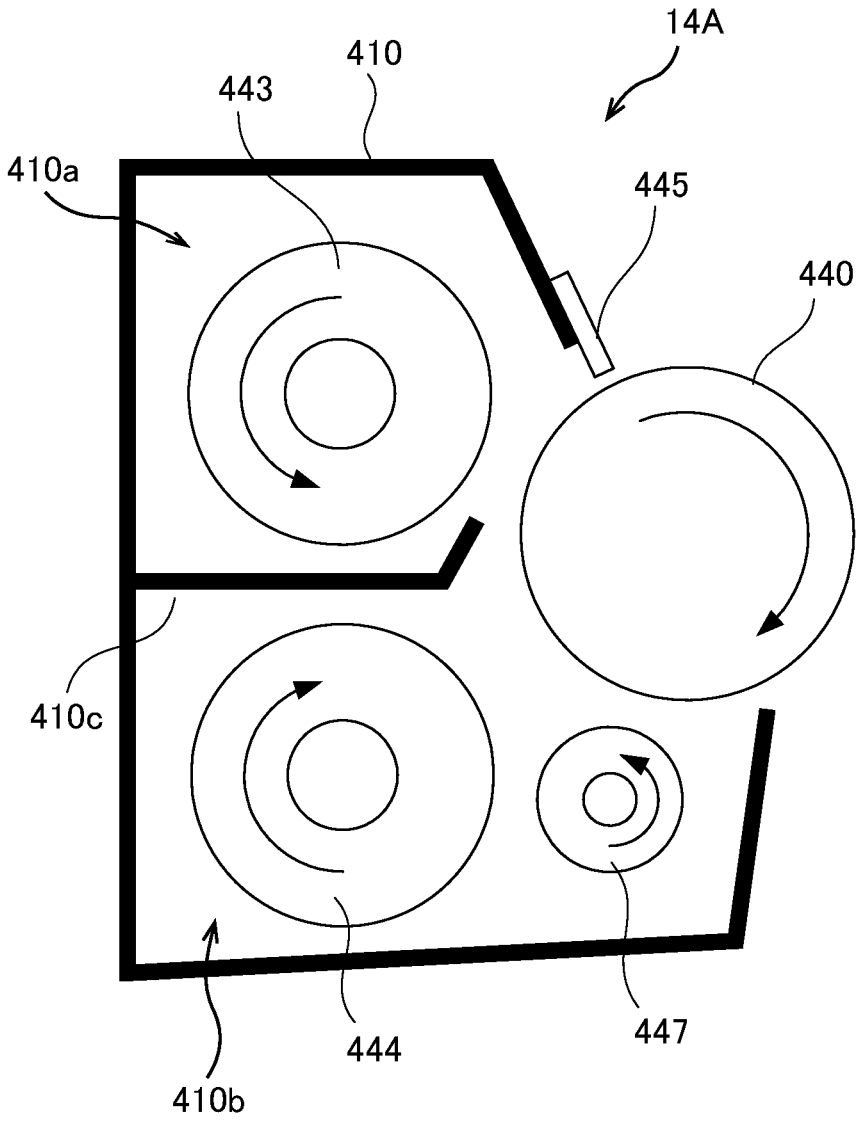
FIG. 9 is a schematic cross-sectional view of a configuration of a developing unit according to a second embodiment.

A second embodiment will be described using FIG. 9 while referring to FIGS. 4 to 8. In the above-described embodiment, a so-called twin-sleeve configuration in which two developing sleeves are arranged side by side has been described. On the other hand, the present embodiment has a so-called single sleeve configuration in which the electrostatic latent image on the photosensitive drum is developed by one developing sleeve 440. Since other configurations and operations are similar to those of the first embodiment described above, similar configurations are denoted by the same reference numerals, description and illustration thereof are omitted or simplified, and hereinafter, portions different from those of the first embodiment will be mainly described.

The developing unit 14A of the present embodiment includes one developing sleeve 440 serving as a developer bearing member. Also in the present embodiment, the first to third conveying screws 443, 444, and 447 are provided. The third conveying screw 447 is disposed below the developing sleeve 440, collects the developer from the developing sleeve 440, and stirs and conveys the developer. Also, in the present embodiment as described above, similarly to the first embodiment, a drive transmission portion that transmits the drive force to the developing sleeve 440 and the third conveying screw 47 and a drive transmission portion that transmits the drive force to the first conveying screw 42 and the second conveying screw 43 are separately provided.

That is, the drive force is input from the first drive input portion 451 to the first drive gear 45 drivingly connected to the developing sleeve 440 and the third conveying screw 47. In addition, the drive force is input from the second drive input portion 452 to the second drive gear 45*b* drivingly connected to the first conveying screw 42 and the second conveying screw 43. In addition, the arrangement of the first and second drive input portions 451 and 452 is also similar to that of the first embodiment.

Specifically, even when the developing unit 14A is located at the pressing position and the first and second drive transmission gears 42*a* and 42*b* mesh with the first and second drive gears 45*a* and 45*b*, the first and second drive input portions 451 and 452 are disposed such that forces in directions canceling each other act on the first and second drive gears 45*a* and 45*b*. As a result, the force of the component in the pressing direction (the direction from the rotation center of the developing sleeve 440 toward the rotation center of the photosensitive drum 11) in the force acting on the first drive gear 45*a* from the first drive input portion 451 and the force of the component in the pressing direction in the force acting on the second drive gear 45*b* from the second drive input portion 452 cancel each other, so that the force added to the pressing force of the developing unit 14A by the pressing member 140 is reduced. Accordingly, also in the present embodiment, similarly to the first embodiment, the gap between the developing sleeve 440 and the photosensitive drum 11 at the pressing position can be appropriately maintained, and the occurrence of image defects can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-115479, filed Jul. 13, 2021, and Japanese Patent Application No. 2022-097827, filed Jun. 17, 2022, which are hereby incorporated by reference herein in their entirety.

What is claimed is:

1. An image forming apparatus comprising:

an image bearing member;

a developing unit including a developer container configured to accommodate a developer, a developer bearing member configured to bear and convey the developer in the developer container to develop an electrostatic latent image formed on the image bearing member, a conveying member configured to convey the developer in the developer container, a first drive gear configured to drive the developer bearing member, and a second drive gear configured to drive the conveying member;

a mounting portion configured to mount the developing unit;

a first drive input portion to which a drive force is input, the first drive input portion including a first drive transmission gear configured to mesh with the first drive gear in a state where the developing unit is mounted to the mounting portion and input the drive force to the first drive gear, and a first urging portion configured to urge the first drive transmission gear toward the first drive gear;

a second drive input portion to which a drive force is input, the second drive input portion including a second drive transmission gear configured to mesh with the second drive gear in a state where the developing unit is mounted to the mounting portion and inputs the drive force to the second drive gear, and a second urging portion configured to urge the second drive transmission gear toward the second drive gear; and a contact-separation mechanism configured to bring the first drive transmission gear and the second drive transmission gear into contact with or to be separated from the first drive gear and the second drive gear, respectively, in a case where the developing unit is mounted to and dismounted from the mounting portion, wherein in a state in which the first drive transmission gear is brought into contact with the first drive gear and the second drive transmission gear is brought into contact with the second drive gear by the contact-separation mechanism, in a case where a direction in which the first drive transmission gear urges the first drive gear using the first urging portion when the drive force is not input to the first drive input portion is defined as a first direction, and a direction in which the second drive transmission gear urges the second drive gear using the second urging portion when the drive force is not input to the second drive input portion is defined as a second direction, the second direction has a force component in a direction opposite to the first direction with respect to a straight line connecting a rotation center of the first drive gear and a rotation center of the second drive gear.

2. The image forming apparatus according to claim 1, wherein the first drive transmission gear and the second drive transmission gear are disposed on opposite sides with the straight line interposed therebetween.

3. The image forming apparatus according to claim 1, wherein the first drive input portion includes, in addition to the first drive transmission gear and the first urging portion, a first swing center gear and a first housing provided to be swingable about the first swing center gear together with the first drive transmission gear, the first urging portion urges the first housing such that the first drive transmission gear moves toward the first drive gear, the second drive input portion includes, in addition to the second drive transmission gear and the second urging portion, a second swing center gear and a second housing provided to be swingable about the second swing center gear together with the second drive transmission gear, and the second urging portion urges the second housing such that the second drive transmission gear moves toward the second drive gear.

4. The image forming apparatus according to claim 3, wherein in a state where the first drive gear is brought into contact with the first drive transmission gear and the second drive gear is brought into contact with the second drive transmission gear by the contact-separation mechanism, in a case where an urging force by the first urging portion is defined as Fsa, a drive transmission force from the first drive transmission gear to the first drive gear is defined as Fga, a drive transmission force from the first swing center gear to the first drive transmission gear is defined as Fha, and a component of a resultant force obtained by combining these forces in the same direction as an urging direction by the first urging portion is defined as Fa when the drive force is input to the first drive input portion, and in a case where an urging force by the second urging portion is defined as Fsb, a drive transmission force from the second drive transmission gear to the second drive gear is defined as Fgb, a drive transmission force from the second swing center gear to the second drive transmission gear is defined as Fhb, and a component of a resultant force obtained by combining these forces in the same direction as an urging direction by the second urging portion is defined as Fb when the drive force is input to the second drive input portion, the first drive input portion and the second drive input portion are arranged such that a direction of the Fa and a direction of the Fb are directions in which the Fa and the Fb cancel each other.

5. The image forming apparatus according to claim 1, wherein the developer container includes a first chamber configured to supply the developer to the developer bearing member, a second chamber in which the developer circulates between the first chamber and the second chamber, and a partition wall configured to partition the developer container into the first chamber and the second chamber, the developing unit includes a first communicating portion configured to allow the developer to move from the second chamber to the first chamber, a second communicating portion configured to allow the developer to move from the first chamber to the second chamber, a first conveying member disposed in the first chamber and configured to convey the developer in a first direction from the first communicating portion to the second communicating portion, a second conveying member disposed in the second chamber and configured to convey the developer in a second direction from the second communicating portion to the first communicating portion, and a third conveying member disposed below the developer bearing member, the third conveying member being configured to collect the developer from the developer bearing member, and stir and convey the developer, and the conveying member is the first conveying member, and the first drive gear drives the developer bearing member and the third conveying member, and the second drive gear drives the first conveying member and the second conveying member.

6. The image forming apparatus according to claim 1, further comprising:

a first motor configured to supply the drive force input to the first drive input portion; and a second motor configured to supply the drive force input to the second drive input portion.

7. An image forming apparatus comprising:

an image bearing member;

a developing unit including a developer container configured to accommodate a developer, a first developer bearing member configured to bear and convey the developer in the developer container to develop an electrostatic latent image formed on the image bearing member, a second developer bearing member arranged in parallel with the first developer bearing member via a predetermined gap, and configured to bear and convey the developer to develop the electrostatic latent image formed on the image bearing member, a conveying member configured to convey the developer in the developer container, a first drive gear configured to drive the first developer bearing member and the second developer bearing member, and a second drive gear configured to drive the conveying member;

a mounting portion configured to mount the developing unit;

a first drive input portion to which a drive force is input, the first drive input portion including a first drive transmission gear configured to mesh with the first drive gear in a state where the developing unit is mounted to the mounting portion and input the drive force to the first drive gear, and a first urging portion configured to urge the first drive transmission gear toward the first drive gear;

a second drive input portion to which a drive force is input, the second drive input portion including a second drive transmission gear configured to mesh with the second drive gear in a state where the developing unit is mounted to the mounting portion and input the drive force to the second drive gear, and a second urging portion configured to urge the second drive transmission gear toward the second drive gear; and a contact-separation mechanism configured to bring the first drive transmission gear and the second drive transmission gear into contact with or to be separated from the first drive gear and the second drive gear, respectively, in a case where the developing unit is mounted to and dismounted from the mounting portion, wherein in a state in which the first drive transmission gear is brought into contact with the first drive gear and the second drive transmission gear is brought into contact with the second drive gear by the contact-separation mechanism, in a case where a direction in which the first drive transmission gear urges the first drive gear using the first urging portion when the drive force is not input to the first drive input portion is defined as a first direction, and a direction in which the second drive transmission gear urges the second drive gear using the second urging portion when the drive force is not input to the second drive input portion is defined as a second direction, the second direction has a force component in a direction opposite to the first direction with respect to a straight line connecting a rotation center of the first drive gear and a rotation center of the second drive gear.

8. The image forming apparatus according to claim 7, wherein the first drive transmission gear and the second drive transmission gear are disposed on opposite sides with the straight line interposed therebetween.

9. The image forming apparatus according to claim 7, wherein the first drive input portion includes, in addition to the first drive transmission gear and the first urging portion, a first swing center gear and a first housing provided to be swingable about the first swing center gear together with the first drive transmission gear, the first urging portion urges the first housing such that the first drive transmission gear moves toward the first drive gear, the second drive input portion includes, in addition to the second drive transmission gear and the second urging portion, a second swing center gear and a second housing provided to be swingable about the second swing center gear together with the second drive transmission gear, and the second urging portion urges the second housing such that the second drive transmission gear moves toward the second drive gear.

10. The image forming apparatus according to claim 9, wherein in a state where the first drive gear is brought into contact with the first drive transmission gear and the second drive gear is brought into contact with the second drive transmission gear by the contact-separation mechanism, in a case where an urging force by the first urging portion is defined as Fsa, a drive transmission force from the first drive transmission gear to the first drive gear is defined as Fga, a drive transmission force from the first swing center gear to the first drive transmission gear is defined as Fha, and a component of a resultant force obtained by combining these forces in the same direction as an urging direction by the first urging portion is defined as Fa when the drive force is input to the first drive input portion, and in a case where an urging force by the second urging portion is defined as Fsb, a drive transmission force from the second drive transmission gear to the second drive gear is defined as Fgb, a drive transmission force from the second swing center gear to the second drive transmission gear is defined as Fhb, and a component of a resultant force obtained by combining these forces in the same direction as an urging direction by the second urging portion is defined as Fb when the drive force is input to the second drive input portion, the first drive input portion and the second drive input portion are arranged such that a direction of the Fa and a direction of the Fb are directions in which the Fa and the Fb cancel each other.

11. The image forming apparatus according to claim 7, wherein the developer container includes a first chamber configured to supply the developer to the first developer bearing member, a second chamber in which the developer circulates between the first chamber and the second chamber, and a partition wall configured to partition the developer container into the first chamber and the second chamber, the developing unit includes a first communicating portion configured to allow the developer to move from the second chamber to the first chamber, a second communicating portion configured to allow the developer to move from the first chamber to the second chamber, a first conveying member disposed in the first chamber and configured to convey the developer in a first direction from the first communicating portion to the second communicating portion, a second conveying member disposed in the second chamber and configured to convey the developer in a second direction from the second communicating portion to the first communicating portion, and a third conveying member disposed below the second developer bearing member, the third conveying member being configured to collect the developer from the second developer bearing member, and stir and convey the developer, the conveying member is the first conveying member, the first drive gear drives the first developer bearing member, the second developer bearing member, and the third conveying member, and the second drive gear drives the first conveying member and the second conveying member.

12. The image forming apparatus according to claim 7, further comprising:

a first motor configured to supply the drive force input to the first drive input portion; and a second motor configured to supply the drive force input to the second drive input portion.

* * * * *